US011661092B2

(12) United States Patent
Plantard et al.

(10) Patent No.: US 11,661,092 B2
(45) Date of Patent: May 30, 2023

(54) CABLEWAY INSTALLATION COMPRISING A RELAY STRUCTURE BETWEEN TWO CABLE LOOPS

(71) Applicant: POMA, Voreppe (FR)

(72) Inventors: Aurélien Plantard, Voreppe (FR); Luc Marnas, Voreppe (FR)

(73) Assignee: POMA, Voreppe (FR)

( * ) Notice: Subject to any disclaimer, the term of this patent is extended or adjusted under 35 U.S.C. 154(b) by 307 days.

(21) Appl. No.: 17/025,984

(22) Filed: Sep. 18, 2020

(65) Prior Publication Data

US 2021/0245788 A1 Aug. 12, 2021

(30) Foreign Application Priority Data

Jul. 23, 2019 (FR) ..... 1908367

(51) Int. Cl.

| | |
|---|---|
| ***B61B 12/02*** | (2006.01) |
| ***B61B 13/12*** | (2006.01) |
| ***B61B 7/04*** | (2006.01) |
| ***B61B 12/00*** | (2006.01) |
| ***B61B 1/00*** | (2006.01) |
| ***B61B 7/00*** | (2006.01) |

(52) U.S. Cl.

CPC ..... *B61B 12/022* (2013.01); *B61B 1/00* (2013.01); *B61B 7/00* (2013.01); *B61B 7/04* (2013.01); *B61B 12/00* (2013.01); *B61B 12/007* (2013.01); *B61B 13/12* (2013.01); *B61B 12/026* (2013.01)

(58) Field of Classification Search

CPC .. B61B 7/04; B61B 7/00; B61B 12/10; B61B 12/026; B61B 12/022; B61B 12/00; B61B 12/007; B61B 12/005; B61B 9/00; B61B 13/12; B61B 1/00

USPC ..... 104/173.2, 178

See application file for complete search history.

(56) References Cited

U.S. PATENT DOCUMENTS 4,669,389 A * 6/1987 Tarassoff ..... B61B 12/10 104/178

5,172,640 A * 12/1992 Cathiard ..... B61B 12/022 104/178

FOREIGN PATENT DOCUMENTS

| | | |
|---|---|---|
| DE | 309241 | 9/1919 |
| EP | 0491632 | 6/1992 |

OTHER PUBLICATIONS

French Search Report for French Application No. FR1908367 dated Apr. 6, 2020, 9 pages.

* cited by examiner

*Primary Examiner* — Zachary L Kuhfuss

(74) *Attorney, Agent, or Firm* — Ray Quinney & Nebeker P.C.; Paul N. Taylor

(57) ABSTRACT

The invention relates to a cableway installation for transporting persons by disengageable vehicles and carrying cable comprising: a first station (1*a*) equipped with a first end pulley, a second station (1*b*) equipped with a second end pulley, a relay structure equipped with a first idler pulley and a second idler pulley, a first cable loop engaged with the first end pulley and the first idler pulley, and a second cable loop engaged with the second end pulley and the second idler pulley. The relay structure comprises a transfer system for transferring vehicles between the first cable loop and the second cable loop and a fixed guiding track supporting a structure translationally moveable with respect to the fixed guiding track, the moveable structure bearing the first idler pulley, the second idler pulley and embarking the vehicle transfer system.

20 Claims, 3 Drawing Sheets

CABLEWAY INSTALLATION COMPRISING A RELAY STRUCTURE BETWEEN TWO CABLE LOOPS

TECHNICAL FIELD OF THE INVENTION

The invention relates to a cable transport installation comprising one or more vehicles, for example gondolas or chairs, borne and driven by cable loops, for the transport of persons or goods.

PRIOR ART

The invention pertains to transport installations and, more specifically, to those intended to ensure an aerial transit between end stations, respectively, a departure station and an arrival station.

More specifically, the invention relates to a gondola lift or chair lift installation connecting two end stations by means of a continuously running carrying-traction cable and gondolas or chairs coupled in line and disengaged from the cable at the entrance into the stations.

Each of the stations is equipped with an end pulley in which the cable passes, a transfer rail on which the gondolas circulate before being recoupled to the cable at the exit of the station and platforms for embarking and/or disembarking passengers.

Transport installations of the type with disengageable gondolas or chairs enable high transport throughputs with light infrastructures.

The increase in the loads transported due, notably, to the increasing size and number of gondolas, as well as the lengthening of routes with important height differences, imply important sections of the carrying-traction cable. These important sections pose technical problems, notably, to ensure a reliable and secure passage of the cable on the pulleys, the cable then proving to be too rigid.

Gondola lift installations comprising two successive sections on either side of an intermediate station in which are able to pass the gondolas circulating on the two sections and in both directions are already known. Each section constitutes an independent installation with a carrying-traction cable and a drive motor. At the entrance of the stations, notably the intermediate station, the gondolas are uncoupled from the cable and slowed down for embarking and/or disembarking passengers.

The intermediate station of this installation comprises a half-loop idler rail to recouple the gondolas to the return strand of the cable of the same section at the exit of the station, after re-acceleration, and a connecting rail between the two sections which enables the transfer of the gondola to the following section where it is re-accelerated before being coupled to the cable. The passengers may thus successively pass through the two sections without leaving their gondola.

However, the presence of an intermediate station between the two sections complicates the overall installation and increases the cost thereof. Moreover, the slowing down of the gondolas in the intermediate station lengthens the duration of the journey and imposes uncomfortable braking and re-acceleration phases on the passengers.

EP0491632 describes a gondola lift installation which comprises a first and a second loop which extend one following the other, a technical relay arranged at the interface of the two loops which is provided with an idler pulley of the first loop and an idler pulley of the second loop and two connecting rails ensuring the transfer of the gondolas between the two loops while avoiding the idler pulleys.

The tensioning system is common to the two loops, by providing in the technical relay a transfer of tension from one loop to the other and a take up of tension by the other loop. For this purpose, the idler pulleys are borne by a support trolley of the gondolas which is displaced on the connecting rails in the direction of the cable. A jack for taking up tension loads the trolley.

Thus, the gondolas are disengaged from a loop and transferred via the trolley to the other loop on which they are re-engaged.

The integration of a technical relay in the line and the division of the carrying cable into two independent closed loops, which extend respectively between the downstream station and the technical relay and between the technical relay and the upstream station, make it possible to reduce notably the section of the cable without requiring modifications of the installation.

However, in this installation, the adjustment of the tension of the cable conjointly on the two loops is awkward on account of the transfer and the take up of tension from one loop to the other.

Yet, to have available a satisfactory capacity for adjusting the tension of the cable at the level of the technical relay, it is necessary to displace the idler pulleys inside this relay, which imposes a technical relay of important length.

Moreover, the connecting rails are supported by a structure independent of the idler pulley support trolley, which poses problems of coordination between the phases of disengagement and engagement of the vehicles.

Another drawback resides in the configuration of the technical relay. Indeed, only the idler pulley support trolley is moveable whereas the other structural elements are fixed which poses problems of compactness, mechanical connection and cohesion between the fixed elements and the moveable elements.

Finally, due to the fact that this technical relay is exempt of embarking and/or disembarking platform, it is not possible to use it to serve an intermediate station, or even to evacuate passengers in the event of breakdown or incident.

DESCRIPTION OF THE INVENTION

The invention aims to overcome these technical problems by simplifying the structure of the technical relay for transferring from one cable loop to the other, and while decreasing the length of the technical relay.

This aim is attained by means of an installation for transporting persons by disengageable vehicles and carrying cable comprising:

- a first end pulley,
- a second end pulley,
- a relay structure equipped with a first idler pulley and a second idler pulley,
- a first cable loop engaged with the first end pulley and the first idler pulley,
- a second cable loop engaged with the second end pulley and the second idler pulley,
- at least one vehicle capable of being coupled alternately to the first cable loop and to the second cable loop by disengageable coupling means.

The relay structure comprises a transfer system for transferring the vehicle uncoupled from the first cable loop and from the second cable loop, from the first cable loop to the second cable loop. In a remarkable manner, the relay structure comprises a fixed guiding track supporting a structure translationally moveable with respect to the fixed guiding track, the moveable structure bearing the first idler pulley, the second idler pulley and the vehicle transfer system.

Thus, according to the invention, the technical relay becomes totally moveable and embarks all the essential mechanical constituents, notably, the idler pulleys, the vehicle transfer system and the means for engaging/disengaging the cable. Thanks to the moveable structure, the technical relay is displaced as a function of the loading of the cables forming the two independent loops.

The end pulleys of the installation may be positioned in end stations, or in other relay structures.

According to an advantageous characteristic, the transfer system comprise at least one connecting rail ensuring the passage of the vehicles between the two cable loops.

According to an embodiment, the transfer system comprise at least one disengagement device capable of uncoupling the vehicle from the first cable loop, preferably situated between the first end pulley and the first idler pulley, and an engagement device capable of coupling the vehicle to the second cable loop, preferably situated between second idler pulley and the second end pulley.

According to another characteristic, the moveable structure is engaged with a force balancing member, arranged for example on or under the fixed guiding track. This force take up member is intended to ensure a nominal tension of the cable loops in the conditions of use. This force balancing member may notably comprise a jack connected to the moveable structure, this jack being able to be for example hydraulic, pneumatic or electromechanical. In an alternative or complementary manner, the force balancing member may comprise a suspended balancing mass.

According to a specific alternative of the invention, the moveable structure comprises a trolley equipped with at least one set of wheels capable of rolling on the fixed guiding track.

Preferably, the moveable structure is open at its two longitudinal ends to enable the passage of the vehicle in transit.

According to another alternative embodiment of the invention, the first idler pulley is rotationally guided with respect to the moveable structure around a first axis of revolution, and the second idler pulley is rotationally guided with respect to the moveable structure around a second axis of revolution, situated at a distance from the first axis of revolution, and preferably parallel to the first axis of revolution.

According to an alternative, the first idler pulley is rotationally guided with respect to the moveable structure around a first axis of revolution, and the second idler pulley is rotationally guided with respect to the moveable structure around a second axis of revolution merged with the first axis of revolution.

Optionally, the moveable structure comprises at least one platform enabling the embarking or the disembarking of passengers or loading. Even in the hypothesis where the moveable structure is not intended to constitute an intermediate station, it can however be equipped to enable the evacuation of passengers or disembarkation in the event of damage or bad weather.

Preferably, this platform is then integrated in the transfer system.

According to the invention, it is also provided that the fixed guiding track is supported at altitude by supports.

The relay structure intended to be integrated in the installation of the invention is particularly compact and comprises an autonomous moveable structure which enables a reliable and precise adjustment of the tension of the cable between the two loops as well as a safe and rapid transfer of the vehicles between the two loops of successive sections.

Moreover, inside this relay structure, the mechanical constituents, the vehicles and thus the passengers are well protected from the exterior environment while passing in the moveable structure which makes the installation of the invention particularly well suited to an implantation in the high mountains where potentially severe meteorological conditions reign.

The installation of the invention may use a carrying-traction cable of reduced section while conserving the advantages, notably, of simplicity, throughput and existing layout of the installation.

It thus offers great exploitation flexibility and maintenance facilities by simple displacement and disengagement of the moveable structure, which guarantees an optimal availability rate.

The installation of the invention operates in a symmetrical manner in both directions of the journey, without jolts or braking, which avoids breakdowns and accidental interruptions of the traffic and thus makes the transport of passengers fluid, comfortable and safe.

BRIEF DESCRIPTION OF THE FIGURES

Other characteristics and advantages of the invention will become clear on reading the description that follows, with reference to the appended figures detailed hereafter.

For greater clarity, identical or similar elements are marked by identical reference signs in all of the figures.

DETAILED DESCRIPTION OF EMBODIMENTS

Figure 1:
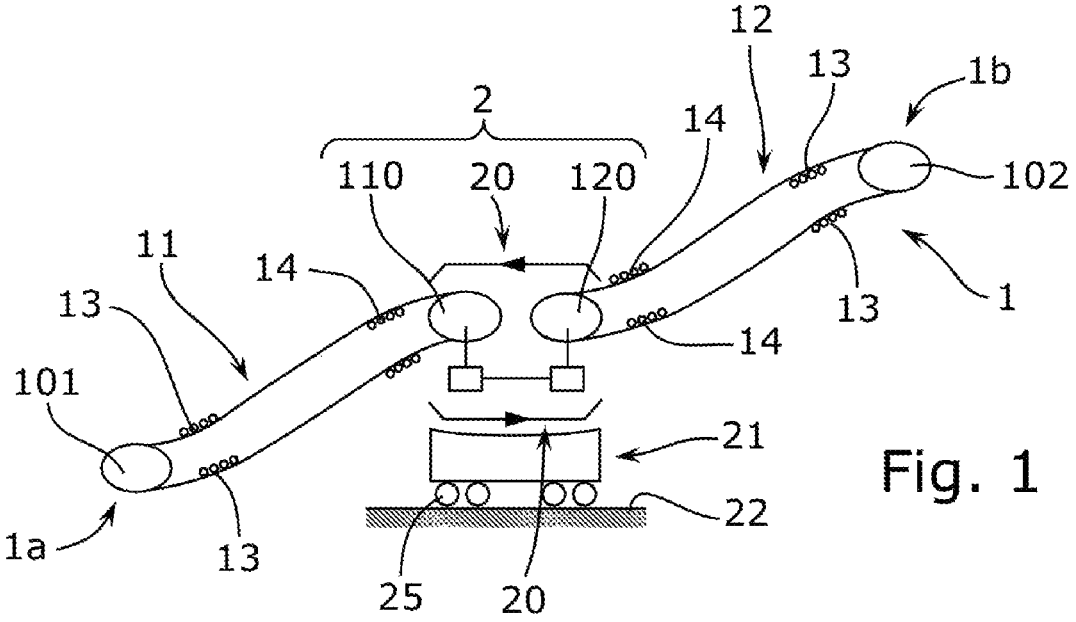
FIG. 1 represents an overall schematic view of an embodiment of the installation of the invention.

FIG. 1 represents an overall schematic view of an embodiment of the installation of the invention.

Generally and as described in EP 0 491 632, this installation comprises a carrying-traction cable for vehicles (not represented). These vehicles are constituted, notably but in a non-limiting manner, of one or more gondola lifts or a series of chair lifts, intended to be displaced on a line 1 which extends in closed circuit between a first end station 1*a*, for example, downstream and a second end station 1*b* situated, for example, upstream of the first end station, while passing on end pulleys 101, 102 arranged in these stations.

Traditionally, the cable of the line 1 is supported by support and compression rollers 13 borne by supports (not represented here). The vehicles are coupled to the cable by means of trolleys with disengageable clamps (not represented), which open at the entrance of the end stations 1*a*, 1*b* to uncouple the vehicles from the cable.

The vehicles circulate in the end stations 1*a*, 1*b* on transfer rails (not represented) at reduced speed, for the embarking and disembarking of passengers, before being re-accelerated and recoupled to the line 1 at the exit of the stations on the return strand of the cable.

The section of the cable is determined as a function of different factors, of which essentially the height difference between the two end stations 1*a*, 1*b* and the load, notably the weight and the number of vehicles supported by the loops of the cable on the line 1.

Traditionally and as illustrated by FIG. 1, the cable line 1 is subdivided into two loops 11, 12, of which one 11 extends in closed circuit between the first end station 1*a* and a technical relay formed of a relay structure 2 while delimiting a first section of the line 1 whereas the other loop 12 extends between this same relay structure 2 and the second end station 1*b* while delimiting a second section of the line 1.

The first cable loop 11 is engaged, on the one hand, with the first end pulley 101 and, on the other hand, with a first idler pulley 110 whereas the second cable loop 12 is engaged, on the one hand, with the second end pulley 102 and, on the other hand, with a second idler pulley 120.

Each of the loops 11, 12 thus passes on an idler pulley, respectively a first idler pulley 110 and a second idler pulley 120, mounted in the relay structure 2. The section of the cable may thus be notably reduced.

In a known manner, the relay structure 2 comprises a transfer system ensuring the passage of the vehicles from one loop to the other. These transfer system comprises at least one connecting rail 20 which connects the two loops 11, 12 while avoiding the two idler pulleys 110, 120 and devices 14 ensuring the disengagement and the engagement of the vehicles on the cable, respectively, at the entrance and exit ends of the connecting rails 20 in an analogous manner to that of transfer rails equipping the end stations 1*a*, 1*b*.

Figure 2:
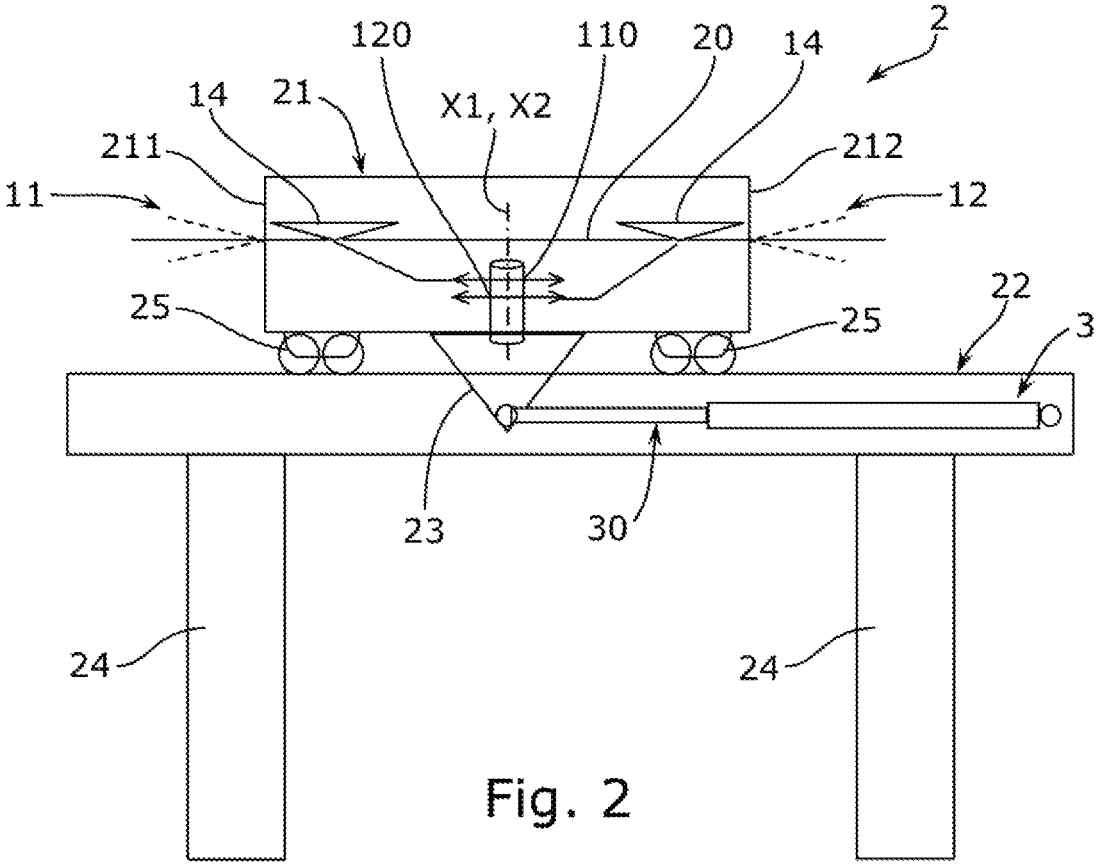
FIG. 2 represents a schematic view of a first embodiment of the relay structure integrated in the installation of the invention.
Figure 3:
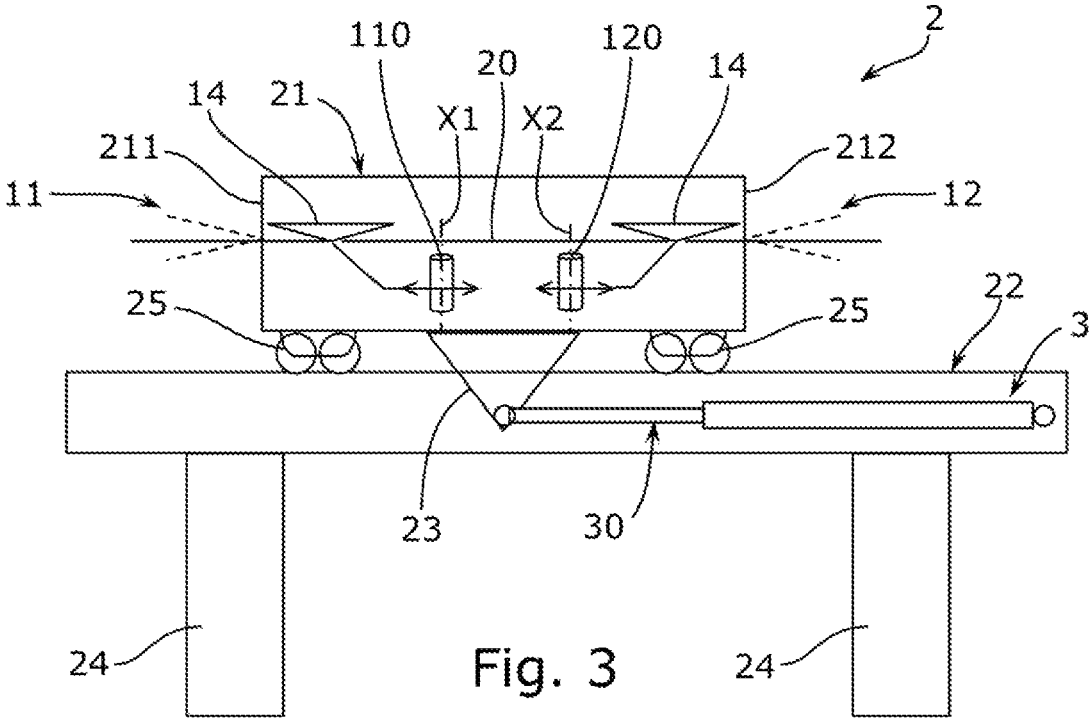
FIG. 3 represents a schematic view of a second embodiment of the relay structure integrated in the installation of the invention.
Figure 4:
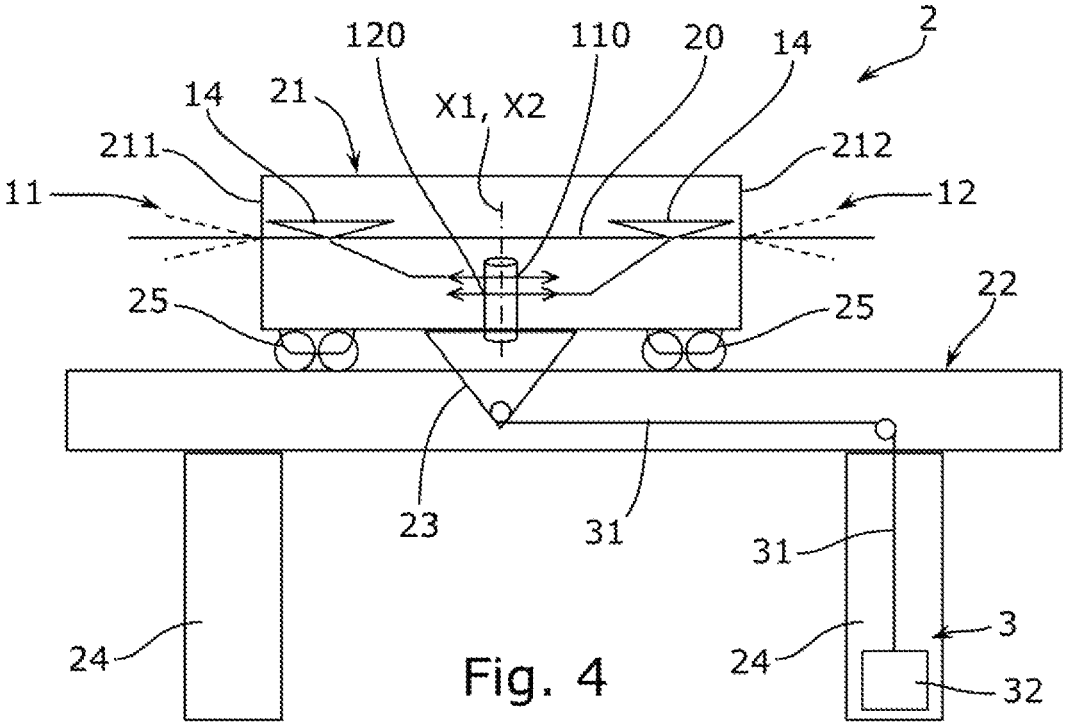
FIG. 4 represents a schematic view of a third embodiment of the relay structure integrated in the installation of the invention.

FIGS. 2, 3 and 4 represent in a schematic and partial manner different embodiments of the relay structure 2 of the transport installation according to the invention.

According to the invention, the relay structure 2 comprises a fixed guiding track 22 supporting a structure 21 translationally moveable with respect to the fixed track.

The moveable structure 21 bears the first idler pulley 110, the second idler pulley 120 and embarks the vehicle transfer system 20 which are thus integral with the structure and capable of being displaced therewith.

In the embodiments represented, the moveable structure 21 is constituted of a trolley equipped with at least two sets of wheels 25 ensuring the rolling on the guiding track 22 of which the upper face is substantially flat. The fixed track 22 is here supported at altitude by supports 24 or uprights, in such a way as to be positioned as close as possible to the plane of the arrival and departure trajectories of the vehicles.

This trolley has, at its two longitudinal ends, openings 211, 212 in the manner of a tunnel to enable the passage under shelter of the vehicles in transit between the loops 11, 12 forming the two sections of the cabled line 1.

It is possible, according to an alternative not represented, to produce the moveable structure 21 in the form of a dolly or a platform bearing, notably, a support frame for the two idler pulleys 110, 120 and the connecting rail(s) 20.

This platform may be provided with a roof making it possible to protect the mechanical constituents from the exterior environment and all access means enabling the intervention of safety and maintenance personnel.

In the embodiment, illustrated by FIG. 3, the axes of the idler pulleys 110, 120 are offset in the direction of the line 1.

Thus, the first idler pulley 110 is rotationally guided with respect to the moveable structure 21 around a first axis of revolution X1, and the second idler pulley 120 is rotationally guided with respect to the moveable structure 21 around a second axis of revolution X2, situated at a distance from the first axis of revolution, and preferably parallel to the first axis of revolution.

The two loops 11, 12 thus move at the same speed while being driven by a motor (not represented) coupled to one of the end pulleys, for example, to the pulley of the downstream station. Each loop 11, 12 may comprise a drive motor, synchronism being ensured by any appropriate means, notably by a link between the two idler pulleys 110, 120.

Preferably, the idler pulleys 110, 120 are idle and the drive of the cable is ensured by the end stations 1*a*, 1*b*, as in the configuration illustrated by FIGS. 2, 3 and 4.

However, according to an alternative not represented, the two idler pulleys could be coupled mechanically by an intercalary shaft, so as to turn in synchronism in the same sense.

In the embodiment illustrated by FIGS. 2 and 4, the first idler pulley 110 is rotationally guided with respect to the moveable structure 21 around a first axis of revolution X1 and the second idler pulley 120 is rotationally guided with respect to the moveable structure 21 around a second axis of revolution X2 which is here merged with the first axis of revolution X1.

In another embodiment, not represented, the idler pulleys may be constituted by a single pulley with two superimposed grooves or double groove, each associated with one of the loops.

The two idler pulleys 110, 120 may be in the plane of the loops 11, 12 and the connecting rails 20 are, in this case, deviated upwards or instead the offsets are shared, the pulleys being slightly offset downwards and the rails upwards. The operation of the technical relay of the relay structure 2 is not modified by these arrangements.

In the two embodiments of the invention, the transfer system comprises connecting rails 20 extending in a rectilinear manner in the extension of the loops 11, 12, to conserve a uniform trajectory of the vehicles. The axes are inclined and rollers deviate the cable 1 in the plane of the idler pulleys 110, 120, in order not to interfere with the trajectory of the vehicles, in a manner well known per se and described, notably, in EP 0 491 632.

According to the invention, the connecting rails 20 are directly borne by the moveable structure 21, for example by its floor, and are equipped with drive means, such as rollers optionally equipped with tyres, which engage by friction the trolleys of the vehicles being displaced on the connecting rails 20 while being uncoupled from the cable.

These rollers are driven by any appropriate means, by a take up of force (not represented) on the cable and turn at the speed of the cable in such a way that the vehicles traverse the moveable structure 21 of the relay structure 2 without slowing down and without changing direction.

Each loop 11, 12 may comprise its own cable tensioning system which cooperates with the respective end pulleys 101, 102, but in a preferential embodiment, a common tensioning system with counterweights or jack cooperates with one of the end pulleys, for example, that of the upstream station.

According to the invention, a force balancing member 3 loads the moveable structure 21 to pull it or to push it in order to be able to translate in both senses, in the direction of the loops 11, 12, to ensure the take up of the tension of the cable of the line 1 and the sharing of forces between the two loops.

The moveable structure 21 is thus engaged with the force balancing member 3 mounted, preferably, on or under the fixed guiding track 22 and which is fastened to the trolley here forming the moveable structure 21.

In the embodiment illustrated by FIGS. 2 and 3, the force balancing member 3 is constituted of a hydraulic jack of which the rod 30 is fixed to the chassis 23 of the moveable structure 21.

In the embodiment of FIG. 4, the force balancing member 3 comprises at least one balancing mass 32 forming ballast which is, on the one hand, suspended from the end of a cable 31 fastened to the moveable structure 21 and passing on an angle pulley 33 and which is guided, on the other hand, in a vertical well here housed inside one of the supports 24.

Where appropriate, a return member (not represented) is connected to the moveable structure 21 on the side opposite to the balancing member 3 to elastically compensate for the action of the mass 33.

According to an alternative of the invention, not represented, the moveable structure 21 comprises at least one platform (not represented) enabling the embarking or the disembarking of passengers in the relay structure 2, either at the stoppage of the vehicles, or during a programmed slowing down phase or instead in the event of breakdown. This platform is integrated, preferably, in the transfer system 20 housed in the moveable structure 21.

The operation of the technical relay integrated in the relay structure 2 is carried out in the following manner.

A vehicle transported on the first loop 11 and arriving at the relay structure 2 penetrates into the moveable structure 21 via its longitudinal entrance opening 211. At this step, the trolley of the vehicle is engaged on the connecting rail 20 whereas the coupling clamp opens to release the vehicle from the cable of the first loop 11.

The vehicle continues its travel inside the moveable structure 21 while being driven by its rollers on the connecting rail 20 in the direction of the second loop 12. On arrival at the end of travel on the connecting rail 20 of the moveable structure 21, the vehicle is coupled onto the cable of the second loop 12 by closing the clamp before or as of the crossing of the step of the longitudinal exit opening 212 of the moveable structure 21.

In the same way, vehicles circulating in the opposite sense traverse the relay structure 2 while rolling on the other connecting rail 20 housed in a symmetrical manner in the moveable structure 21. The passage in the station 2 thus takes place under shelter, without slowing down and without notable change of route, which avoids oscillations and shaking of the vehicle.

The integration of the moveable structure 21 in the relay structure 2 does not pose any difficulty since it is laid down and guided on the fixed track 22 with a freedom of longitudinal translation and may be displaced easily in the event of breakdown or disengaged by crane for heavy maintenance operations.

The relay structure 2 is not necessarily situated at the mid-point on the line 1 between the two sections and a change of direction is possible at the level of the station between the two sections of the line 1 while reinforcing the anchoring.

The invention is not limited to the embodiments more particularly described and represented, but it extends to any alternative remaining within the scope of equivalences, notably, to that of a technical relay arranged in several modules translationally moveable on the fixed track or instead that where the technical relay does not comprise means for driving the vehicles on the connecting rails 20, these being displaced mainly by gravity.

Where appropriate, one and/or the other of the stations 1*a*, 1*b* described as end stations of the installation is itself a relay structure of structure similar to the station 2, ensuring a transition to another section of the installation.

Naturally, the embodiments illustrated by the figures presented above are only given as non-limiting examples. It is explicitly provided that these different embodiments and alternatives can be combined together to propose others thereof.

The invention claimed is:

1. A cableway installation comprising:

a first end pulley, a second end pulley, a relay structure equipped with a first idler pulley and a second idler pulley, a first cable loop engaged with the first end pulley and the first idler pulley, a second cable loop engaged with the second end pulley and the second idler pulley, at least one vehicle capable of being coupled alternately to the first cable loop and to the second cable loop by disengageable coupling means, wherein the relay structure comprises a transfer system for transferring the vehicle uncoupled from the first cable loop and from the second cable loop, from the first cable loop to the second cable loop; and a fixed guiding track, which supports a movable structure translationally moveable with respect to the fixed guiding track, the moveable structure bearing the first idler pulley, the second idler pulley and the vehicle transfer system, wherein the moveable structure is open at two longitudinal ends of the moveable structure to enable the passage of the vehicle in transit.

2. The cableway installation of claim 1, wherein the transfer system comprises at least one connecting rail ensuring the passage of the vehicles between the two cable loops.

3. The cableway installation of claim 1, wherein the transfer system comprises at least one disengagement device capable of uncoupling the vehicle from the first cable loop.

4. The cableway installation of claim 3, wherein the disengagement device is situated between the first end pulley and the first idler pulley.

5. The cableway installation of claim 3, wherein the transfer system comprises at least one engagement device capable of coupling the vehicle to the second cable loop.

6. The cableway installation of claim 5, wherein the engagement device is situated between the second idler pulley and the second end pulley.

7. The cableway installation of claim 5, wherein the moveable structure is engaged with a force balancing member.

8. The cableway installation of claim 7, wherein the force balancing member is positioned under the fixed guiding track.

9. The cableway installation of claim 7, wherein the second axis of revolution is parallel to the first axis of revolution.

10. The cableway installation of claim 7, wherein the first idler pulley is rotationally guided with respect to the moveable structure around a first axis of revolution and the second idler pulley is rotationally guided with respect to the moveable structure around a second axis of revolution situated at a distance from the first axis of revolution.

11. The cableway installation of claim 7, wherein the first idler pulley is rotationally guided with respect to the moveable structure around a first axis of revolution, and the second idler pulley is rotationally guided with respect to the moveable structure around a second axis of revolution merged with the first axis of revolution.

12. The cableway installation of claim 10, wherein the fixed guiding track is supported at an altitude above the ground by supports.

13. The cableway installation of claim 11, wherein the fixed guiding track is supported at an altitude above the ground by supports.

14. The cableway installation of claim 1, wherein the moveable structure is engaged with a force balancing member.

15. The cableway installation of claim 14, wherein the force balancing member comprises a jack connected to the moveable structure.

16. The cableway installation of claim 14, wherein the force balancing member comprises a suspended balancing mass.

17. The cableway installation according to claim 1, wherein the moveable structure comprises at least one trolley equipped with at least one set of wheels capable of rolling on the fixed guiding track.

18. The cableway installation of claim 1, wherein the first idler pulley is rotationally guided with respect to the moveable structure around a first axis of revolution and the second idler pulley is rotationally guided with respect to the moveable structure around a second axis of revolution situated at a distance from the first axis of revolution.

19. The cableway installation of claim 1, wherein the first idler pulley is rotationally guided with respect to the moveable structure around a first axis of revolution, and the second idler pulley is rotationally guided with respect to the moveable structure around a second axis of revolution merged with the first axis of revolution.

20. The cableway installation of claim 1, wherein the fixed guiding track is supported at an altitude above the ground by supports.

* * * * *